US005695357A

United States Patent [19]

Wright

[11] Patent Number: 5,695,357

[45] Date of Patent: Dec. 9, 1997

[54] CABLE CONNECTOR KIT, CABLE CONNECTOR ASSEMBLY AND RELATED METHOD

[75] Inventor: John O. Wright, York, Pa.

[73] Assignee: Osram Sylvania Inc., Danvers, Mass.

[21] Appl. No.: 709,936

[22] Filed: Sep. 9, 1996

[51] Int. Cl.[6] ..... H01R 4/24

[52] U.S. Cl. ..... 439/394; 439/731; 439/467; 439/825; 29/877

[58] Field of Search ..... 439/578, 585, 439/592, 593, 394, 596, 459, 675, 696, 687, 731, 656, 697, 404, 405, 417, 825, 467; 29/825, 828, 854, 855, 877

[56] References Cited

U.S. PATENT DOCUMENTS 5,083,934 1/1992 Kawaguchi ..... 439/394
5,362,251 11/1994 Bielak ..... 439/394
5,482,475 1/1996 Kawaguchi ..... 439/596
5,562,506 10/1996 Wright ..... 439/578
5,607,320 3/1997 Wright ..... 439/394

*Primary Examiner*—Neil Abrams
*Assistant Examiner*—Yong Ki Kim
*Attorney, Agent, or Firm*—William H. McNeill

[57] ABSTRACT

A cable connector kit is provided which may be assembled to electrically and mechanically connect a central conductor of a coaxial cable to a male or female contact. An upper and a lower insulator are provided in the kit, such insulators being attachable to each other to form an insulator body having a cavity therein. The lower insulator includes an anvil which extends into such cavity and the upper insulator includes a compressing member which extends into such cavity and mates with the anvil. When assembled, a cable connector assembly is provided wherein the central conductor overlaps a portion of the contact, the central conductor and contact portion being sandwiched between the anvil and compressing member.

23 Claims, 3 Drawing Sheets

CABLE CONNECTOR KIT, CABLE CONNECTOR ASSEMBLY AND RELATED METHOD

TECHNICAL FIELD

The present invention relates to a cable connector kit, a cable connector assembly and a method of electrically and mechanically connecting a conductor to a contact. The present invention is particularly useful in connection with an antenna connector.

BACKGROUND ART

A typical cable connector assembly such as, without limitation, a connector assembly comprising an antenna connector and an antenna cable such as those used in the automobile industry for radios includes a male connector body generally in the form of a plug and a female connector body generally in the form of a ferrule which forms a socket. In use, the male connector body is plugged into the female connector body to effect a mechanical and electrical connection between the two. Typically, an antenna cable in the form of a coaxial cable is electrically and mechanically attached to one of the connectors such as the female connector, and the other connector, such as the male connector, is electrically and mechanically attached to a circuit such as a circuit on a printed circuit board. In such prior art devices the lack of satisfactory tactile feedback makes it difficult to know when a suitable connection has been made. In addition, in assembling prior art connector assemblies, it is usually necessary to trim the end of the coaxial cable and then fold the grounding braid back upon the cable to provide a satisfactory ground. Further, the grounding between the mating connectors has not always been satisfactory due to the somewhat loose connection between the male and female connectors. Efforts to tighten up on such connections provides mating connectors which are difficult to couple together. In addition, many prior art connector assemblies require the use of solder.

DISCLOSURE OF THE INVENTION

It is an object of the present invention to provide an improved cable connector assembly.

It is another object of the present invention to provide a cable connector assembly which provides tactile feedback when coupled to a mating connector.

It is a further object of the present invention to provide a cable connector assembly which does not require trimming of the coaxial cable to which the connector is to be attached and the folding of the grounding braid back upon itself.

Yet a further object of the present invention is to provide a cable connector assembly which allows for high pressure grounding between mated connectors.

Another object of the present invention is to provide a cable connector assembly which allows for force differentiation which facilitates the coupling and uncoupling of mating connectors.

Yet another object of the present invention is to provide a cable connector assembly which does not require the use of solder.

Another object of the present invention is to provide an improved method of electrically and mechanically connecting a conductor to a contact.

Yet another object of the present invention is to provide an improved cable connector kit which will facilitate all of the foregoing objectives.

These and other objects are achieved, in one aspect of the invention, by providing a cable connector kit, a cable connector assembly and a method of electrically and mechanically connecting a conductor to a contact. The parts of the kit may comprise a lower insulator having an anvil protruding from an inner surface of the lower insulator, and an upper insulator having a compressing member extending from an inner surface of the upper insulator. The cable connector assembly may be provided by attaching the upper insulator to the lower insulator to provide a connector body having a cavity bounded by the inner surface of the upper insulator and the inner surface of the lower insulator. The compressing member and the anvil are positioned relative to the inner surface of the upper member and the inner surface of the lower member, respectively, to provide opposing compressing surfaces within the cavity, when the upper insulator is attached to the lower insulator, to electrically and mechanically connect together a conductor and a contact positioned therebetween. The method involves the manner in which these components in addition to optional further components may be assembled to provide a cable connector assembly.

BEST MODE FOR CARRYING OUT THE INVENTION

Figure 1:
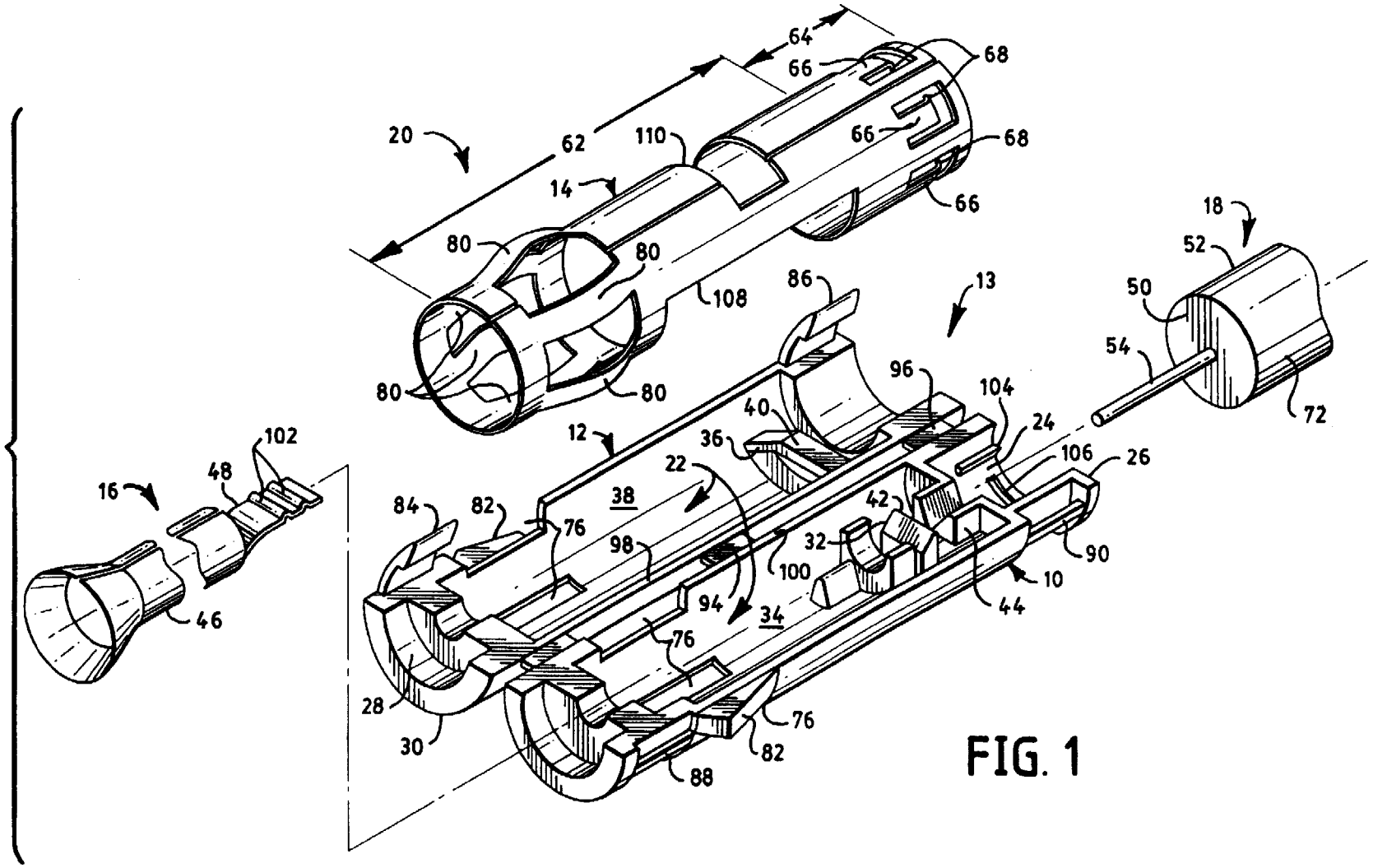
FIG. 1 is an exploded perspective view showing the interrelationship of various components which may comprise the cable connector kit embodying one form of the present invention.

For a better understanding of the present invention, together with other and further objects, advantages and capabilities thereof, reference is made to the following disclosure and appended claims taken in conjunction with the above-described drawings.

The embodiment of this invention which is illustrated in the drawings is particularly suited for achieving the objects of this invention.

Figure 2:
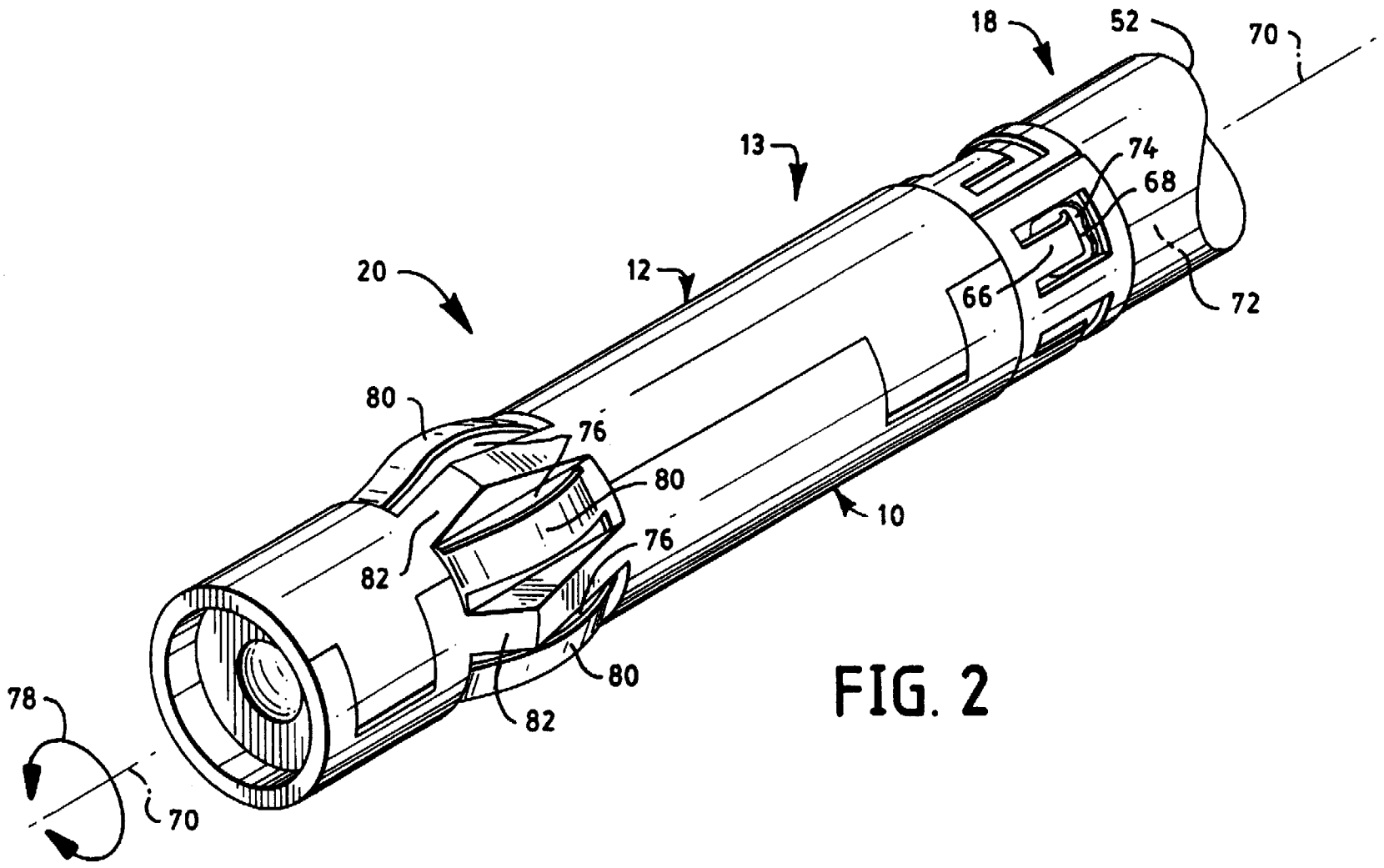
FIG. 2 is a perspective view of the cable connector assembly which may be formed using the kit of FIG. 1.

FIG. 1 depicts four kit components which may be assembled to provide an electrical and mechanical connection between a contact and a cable. In particular, FIG. 1 depicts a lower insulator 10 and an upper insulator 12 which may be connected together to form an insulator body 13 as described herein, and a conductive shell 14 and contact 16. Conductive shell 14 and contact 16 may be assembled with the lower insulator 10 and upper insulator 12 to electrically and mechanically connect together a conductor such as, for example, a coaxial cable 18 and the contact 16 as described herein thereby forming a cable connector assembly 20 as depicted in FIG. 2. Although contact 16 is depicted as a ferrule-type female contact, contact 16 may be replaced with a pronged-type male contact (not shown) if desired.

In FIGS. 1 and 2 the lower insulator 10 is connected to the upper insulator 12 to form insulator body 13 having a cavity 22 therein between the lower and upper insulators. A first inlet 24 to cavity 22 is provided at end 26 of the insulator body 13 and a second inlet 28 to cavity 22 is provided at an opposite end 30. An anvil 32 protrudes into cavity 22 from an inner surface 34 of the lower insulator 10, and a compressing member 36 protrudes into cavity 22 from an opposite inner surface 38 of the upper insulator 12, cavity 22 being bounded by inner surfaces 34 and 38. The compressing member 36 and the anvil 32 are aligned relative to each other so as to provide respective opposing compressing surfaces 40 and 42 within cavity 22. In a preferred embodiment the compressing member 36 is resilient.

The lower insulator 10 includes a guide member 44 which is positioned between, and aligned with, the anvil 32 and the inlet 24. The guide member 44 extends into cavity 22 from the inner surface 34 of the lower insulator 10.

Figure 3:
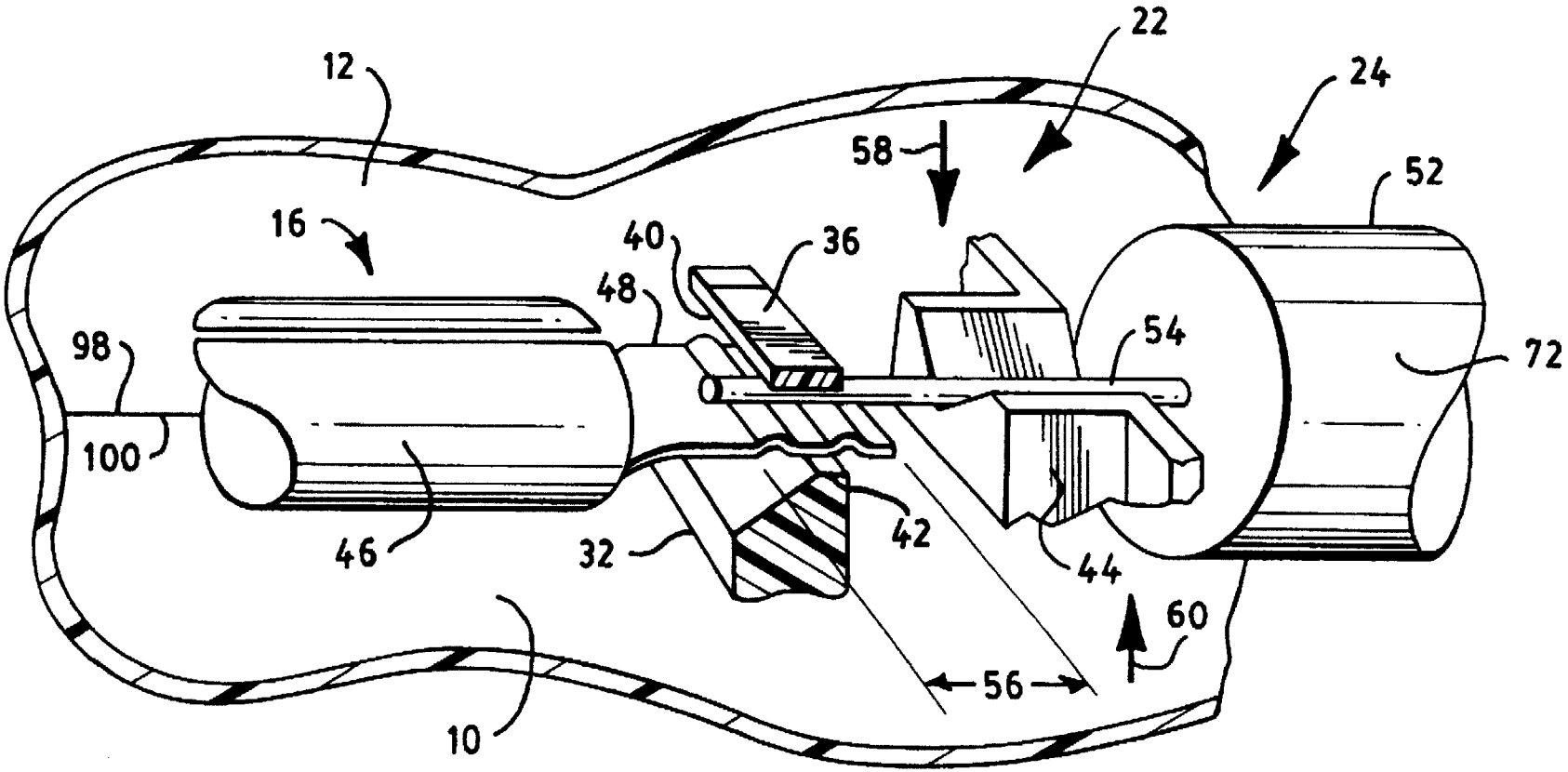
FIG. 3 is a partial perspective view depicting the electrical and mechanical connection of the connector and contact of the embodiment of FIGS. 1 and 2.

Contact 16 includes a first contact segment 46 inserted into the cavity 22 at the inlet 28 and a second contact segment 48 extending from the first contact segment. The second contact segment 48 is positioned in the cavity 22 and adjacent the anvil 32 as depicted in FIG. 3. An end 50 of conductor 18 is inserted into inlet 24. Conductor 18 is a conventional coaxial cable 52 having a center conductor 54. Center conductor 54 extends into cavity 22. In particular, and with reference to FIG. 3, when assembling the cable connector assembly 20, the center conductor 54 may be inserted into inlet 24 and guided into cavity 22 by being extended through the V-shaped guide member 44. The center conductor 54 is extended in this manner until it overlaps with the second contact segment 48 of contact 16 adjacent anvil 32. The lower insulator 10 is then connected to the upper insulator 12 so that the second contact segment and the overlapping center conductor are sandwiched between the anvil 32 and the compressing member 36. In the embodiment of FIG. 3, the center conductor 54 and the second contact segment 48 overlap a length 56 and are mechanically and electrically connected together as a result of opposing compressive forces urged in directions 58 and 60 by respective compressing surfaces 40 and 42.

Such compressive forces may be effected, for example, by positioning the resilient compressing member 36 and the anvil 32 relative to respective inner surfaces 38 and 34, and therefore relative to each other such that when the overlapping central conductor 54 and second contact segment 48 are positioned on surface 42 of the anvil 32, and the upper insulator 12 is connected to the lower insulator 10, the resilient compressing member will cooperate with the anvil to squeeze the overlapping central conductor and contact segment therebetween.

The conductive shell 14 includes a first shell segment 62 which is adapted to be positioned in cavity 22 and a second shell segment 64 which is adapted to extend through the inlet 24 and out of the cavity. The second shell segment 64 comprises a plurality of arms 66 each of which comprises a portion 68 which is bent towards a longitudinal axis 70 of the insulator body. Each respective portion 68 extends through a covering or jacket 72, and contacts a grounding braid 74, of the cable 18. If desired, each arm 66 may be tapered.

The insulator body 13 comprises a plurality of elongated apertures 76 which are spaced in a circumferential direction 78 relative to the longitudinal axis 70 of the insulator body. The conductive shell 20 comprises a plurality of protruding and resilient conductive elements 80 which are also spaced in the circumferential direction 78, each protruding conductive element 80 protruding through a respective elongated aperture 76 and out of cavity 22. Due to the penetration of the portions 68 into the grounding braid 74, when the cable connector assembly 20 is plugged into a mating receptacle in the usual manner, the conductive elements provide ground to the cable grounding braid. In FIGS. 1 and 2, the insulator body 13 has a plurality of ribs 82 which are also spaced in the circumferential direction 78. Each respective rib 82 is positioned between a pair of adjacent apertures 76, having a respective conductive element 80 extending therethrough, and protrude away from longitudinal axis 70. In this manner, each rib 82 protrudes between adjacent protruding conductive elements 80. Such ribs are asymmetrical as depicted in FIGS. 1 and 2 to provide tactile feed-back of correct installation when the cable connector assembly 20 is plugged into a mating receptacle.

The upper insulator 12 has two fasteners in the form of respective resilient clips 84 and 86. Similarly, the lower insulator 10 has two mating fasteners in the form of respective catch members 88 and 90. Upper insulator 12 is pivotally connected to lower insulator 10 by hinge elements 92, 94, 96 which extend between edges 98 and 100. In use, upper insulator 12 and lower insulator 10 may be pivoted relative to each other about hinge elements 92, 94, 96 and connected together by snapping together clip 84 and catch member 88 and clip 86 and catch member 90. It will be apparent to those skilled in the art that the lower insulator 10 and the upper insulator 12 may be provided as completely separate elements, no hinge elements 92, 94, 96 being provided. In such an embodiment, additional clips 84 and 86 and catch members 88 and 90 may be provided at edges 98 and 100, respectively, to facilitate the connection of the lower insulator 10 to the upper insulator 12.

Fabrication of the various components described herein may be accomplished using conventional procedures. For example, the upper and lower insulator, whether hinged together or provided as separate pieces, may be molded from a plastic material such as, without limitation, nylon or polypropylene. The conductive shell and the contact, whether male or female, may be stamped from a metal sheet and then rolled and/or bent if required to form the desired configuration.

Such components are useful in providing a cable connector assembly as described herein and may be grouped and packaged as desired to provide a cable connector kit useful in electrically and mechanically connecting together a contact and a conductor. For example, to effect an electrical and mechanical connection between the second contact segment 48 of contact 16 and the central conductor 54 of coaxial cable 52 the conductive shell 14 may be inserted into the lower insulator 10 such that shell segment 62 is positioned in the portion of cavity 22 provided by the lower insulator 10 and the shell segment 64 extends out of such cavity. The contact may then be inserted into end 30 of the lower insulator 10 such that a portion of the first contact segment 46 is adjacent end 30 and the second contact segment 48 extends to anvil 32. As depicted in FIG. 3, the second contact segment is inserted into cavity 22 until it rests upon surface 42 of anvil 32. The second contact segment 48 may be provided with ribs 102 to facilitate the connection between the contact and the central conductor. The central conductor 54 is inserted into opposite end 26 of the lower insulator 10 such that a segment of the central conductor overlaps the second contact segment 48 as depicted at length 56 in FIG. 3. The lower insulator 10 and/or the upper insulator 12 may be provided with ribs 104, 106 to facilitate mechanical connection of the cable 18 to the insulator body when the upper insulator and lower insulator are connected together. In particular, such ribs 104, 106 will be depressed into the cover 72 of the cable 18 when such connection is effected. Ribs 104, 106 may be off-set, extending in axial (ribs 104) and circumferential (ribs 106) directions. When the second contact segment 48 and the central conductor 54 are overlapped and in place relative to anvil 32, the upper insulator 12 is attached to the lower insulator 10 causing the compressing member 36 to sandwich the central conductor and the second contact segment between the compressing member 36 and the anvil 32 to effect the mechanical and electrical connection between the central conductor and the contact. The conductive shell 14 comprises cut-out portions 108, 110 to respectively allow its insertion into the portion of cavity 22 of the lower insulator 10 and the compressing action of the compressing member 36 when the upper insulator 12 is attached to the lower insulator 10. The cable connector assembly may be completed by bending the portions 68 of arms 66 towards axis 70 causing the portions 68 to penetrate the covering 72 of cable 52 and contact the grounding braid 74.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

What is claimed is:

1. A cable connector assembly, comprising;

a lower insulator connected to an upper insulator to form an insulator body, said insulator body having a cavity therein between said lower insulator and said upper insulator, a first inlet to said cavity at one end of said insulator body, and a second inlet to said cavity at an opposite end of said insulator body, an anvil protruding into said cavity from an inner surface of said lower insulator and a compressing member protruding into said cavity from an opposite inner surface of said upper insulator, said compressing member and said anvil being aligned relative to each other to provide opposing compressing surfaces.

2. The cable connector assembly of claim 1 wherein said lower insulator further comprises a guide member positioned between, and aligned with, said anvil and said first inlet, said guide member extending into said cavity from an inner surface of said lower insulator.

3. The cable connector assembly of claim 1 wherein said compressing member is resilient.

4. The cable connector assembly of claim 1 further comprising a contact having a first contact segment inserted into said cavity at said second inlet and a second contact segment extending from said first contact segment and being positioned in said cavity and adjacent said anvil, and further comprising a cable end inserted into said first inlet, said cable end having a center conductor extending into said cavity and overlapping with said second contact segment adjacent said anvil, said second contact segment and said overlapping center conductor being sandwiched between said anvil and said compressing member.

5. The cable connector assembly of claim 4 wherein said lower insulator further comprises a guide member positioned between, and aligned with, said anvil and said first inlet, said guide member extending into said cavity from an inner surface of said lower insulator, said center conductor extending through said guide member.

6. The cable connector assembly of claim 4 further comprising a conductive shell comprising a first shell segment which is positioned in said cavity and a second shell segment which extends through said first inlet and out of said cavity, said second shell segment comprising a plurality of arms having respective portions which are bent towards a longitudinal axis of said insulator body, said respective portions extending through a covering, and contacting a grounding braid, of said cable end.

7. The cable connector assembly of claim 6 wherein said insulator body comprises a plurality of spaced, elongated apertures extending in a circumferential direction relative to a longitudinal axis of said insulator body, and further wherein said conductive shell comprises a plurality of protruding conductive elements extending in said circumferential direction, each respective protruding conductive element protruding through a respective elongated aperture and out of said cavity.

8. The cable connector assembly of claim 7, wherein said insulator body comprises a plurality of ribs extending in said circumferential direction, each respective rib protruding between adjacent protruding conductive elements.

9. The cable connector assembly of claim 8 wherein said upper insulator comprises at least one fastener and said lower insulator comprises at least one mating fastener, said fastener and said mating fastener being coupled together to connect said upper insulator to said lower insulator.

10. The cable connector assembly of claim 9 wherein said compressing member is resilient.

11. A cable connector kit, comprising;

a lower insulator having an anvil protruding from an inner surface of said lower insulator, and an upper insulator having a compressing member extending from an inner surface of said upper insulator, said upper insulator being adapted for attachment to said lower insulator to provide a connector body having a cavity bounded by said inner surface of said upper insulator and said inner surface of said lower insulator, said compressing member and said anvil being positioned relative to said inner surface of said upper member and said inner surface of said lower member, respectively, to provide opposing compressing surfaces within said cavity when said upper insulator is attached to said lower insulator.

12. The cable connector kit of claim 11 wherein said lower insulator further comprises a guide member positioned between, and aligned with, said anvil and said first inlet, said guide member extending into said cavity from an inner surface of said lower insulator.

13. The cable connector kit of claim 11 wherein said compressing member is resilient.

14. The cable connector kit of claim 11 further comprising a contact having a first contact segment adapted to be inserted into said cavity at said second inlet and a second contact segment extending from said first contact segment and adapted to be positioned in said cavity and adjacent said anvil.

15. The cable connector kit of claim 11 further comprising a conductive shell comprising a first shell segment adapted to be positioned in said cavity and a second shell segment adapted to extend through said first inlet and out of said cavity, said second shell segment comprising a plurality of arms having respective portions which are adapted to be bent towards a longitudinal axis of said insulator body, said respective portions adapted to extend through a covering, and contact a grounding braid, of a cable when said cable is inserted into said first inlet.

16. The cable connector kit of claim 15 wherein said insulator body comprises a plurality of spaced, elongated apertures extending in a circumferential direction relative to a longitudinal axis of said insulator body, and further wherein said conductive shell comprises a plurality of protruding conductive elements, respective protruding conductive elements of said plurality of protruding conductive elements being adapted to protrude through a respective elongated aperture and out of said cavity.

17. The cable connector kit of claim 16, wherein said insulator body comprises a plurality of ribs extending in said circumferential direction, each respective rib adapted to protrude between adjacent protruding conductive elements when said conductive shell is inserted into said cavity.

18. The cable connector kit of claim 11 wherein said upper insulator comprises at least one fastener and said lower insulator comprises at least one mating fastener, said fastener and said mating fastener being adapted to be coupled together to connect said upper insulator to said lower insulator.

19. The cable connector kit of claim 15 further comprising a contact having a first contact segment adapted to be inserted into said cavity at said second inlet and a second contact segment extending from said first contact segment and adapted to be positioned in said cavity and adjacent said anvil.

20. The cable connector kit of claim 14 wherein said lower insulator is pivotally attached to said upper insulator.

21. A method of electrically and mechanically connecting a conductor to a contact, comprising the steps of:

(a) inserting a contact into one end of a lower insulator such that a first contact segment of said contact is adjacent said one end and a portion of a second contact segment of said contact extends to an anvil which protrudes away from an inner surface of said lower insulator;

(b) inserting a conductor into an opposite end of said lower insulator such that a segment of said conductor overlaps said portion; and (c) attaching an upper insulator to said lower insulator such that a compressing member which protrudes away from an inner surface of said upper insulator body sandwiches said segment of said conductor and said portion, between said anvil and said compressing member.

22. The method of claim 21 wherein steps (a) and (b) are preceded by the step of placing a conductive shell into said lower insulator.

23. The method of claim 22 further including the step of pressing a portion of said conductive shell through a covering, and into contact with a grounding braid, of said conductor.

* * * * *